US005564288A

United States Patent [19]

Lewis

[11] Patent Number: 5,564,288

[45] Date of Patent: Oct. 15, 1996

[54] COOLER WITH FLOATING SECTION

[76] Inventor: David L. Lewis, 188 Carmel Hill Rd., Woodbury, Conn. 06798

[21] Appl. No.: 377,757

[22] Filed: Jan. 25, 1995

[51] Int. Cl.[6] ..... F25D 3/08

[52] U.S. Cl. ..... 62/372; 62/464; 62/457.1

[58] Field of Search ..... 62/457.1, 457.2, 62/457.5, 250, 329, 459, 464, 371, 372, 529

[56] References Cited

U.S. PATENT DOCUMENTS 309,233 12/1884 Luhmann ..... 62/371
518,096 4/1894 Davis ..... 62/464
5,048,305 9/1991 Taub ..... 62/372
5,433,085 7/1995 Rogers ..... 62/372

*Primary Examiner*—Henry A. Bennett
*Assistant Examiner*—William C. Doerrler
*Attorney, Agent, or Firm*—Pepe & Hazard

[57] ABSTRACT

A cooler for storing beverage containers on ice, includes an outer container and a buoyant inner container assembly which is dimensioned to slide vertically within the outer container. A container recess is provided in the upper surface of the inner container assembly to hold beverage containers and ice, and the assembly includes a drain for the liquid formed by melting ice from the recess into the outer container. The inner container assembly has a buoyancy which will float it upon the liquid which is drained into the outer container.

13 Claims, 3 Drawing Sheets

COOLER WITH FLOATING SECTION

BACKGROUND OF THE INVENTION

The present invention relates to coolers, and, more particularly, to display coolers for beverage containers.

Display coolers for individual beverage containers on ice are widely employed at consumer point of purchase locations to entice consumers into an impulse purchase of the beverage product within the cooler, and in promotional applications. The standard cooler has one graphic image that is wrapped around the side of the cooler and generally promotes the product which is in the cooler. The primary advantage of the standard display cooler is that it is relatively easily transported and inexpensive in comparison to display refrigerators. In addition, the standard display cooler does not require utility hookups, and simply places the beverage containers in ice cubes to cool the beverage.

Although they are commonly insulated, the ice in the standard display cooler eventually melts and creates an "ice water bath." Separate labels often become soaked and peel from glass beverage containers floating in the ice water bath which results in the ice water becoming cloudy therefrom. The visual appeal of the displayed beverage diminishes significantly when the beverage container appears to be floating in a cloudy ice water bath. It is also considered less sanitary to float beverage containers in ice water baths than to intermix them with ice alone.

In order to avoid the formation of an ice water bath, some display coolers are provided with continuous drainage. However, a permanent drainage hook-up increases the cost of the unit and decreases its locatability.

One solution, which does not require a permanent drain hook-up, is to drain the water into a reservoir which is located within the display cooler. Although an integral reservoir eliminates the problem of the ice water bath, it involves certain tradeoffs. Firstly, creating a separate reservoir within the display cooler often results in decreasing the volume of the cavity which holds the beverage containers and ice. As a result of this tradeoff, reservoirs are often made small and require frequent drainage to permit draining from the area about the beverage containers and prevent water overflow.

Another drawback with current display cooler reservoirs is that they will not drain properly if the drain hose for the reservoir is held higher than the water level in the reservoir. The standard practice is to drain the contents of the reservoir into a 2½–5 gallon pail and carry it away to be discarded. The height of the pail makes it necessary to locate the cooler reservoir higher than the top of the pail in order for gravity to drain it properly. The drain hose height in the side of the cooler also dictates the height of the pail which may be used to drain the cooler. The larger is the pail size, the higher is the drain hose location, and the higher is the drain hose location, the less volume there is in the cooler available for beverage containers.

Accordingly, it is an object of the present invention to provide a novel display cooler for beverage containers and ice which is effective to drain water from the recess holding the ice and beverage containers into an integral reservoir.

It is also an object to provide such a cooler which has an expandable reservoir compartment.

Another object is to provide a reservoir drain which will operate effectively when the outlet of the drain hose is higher than the water level in the reservoir.

Still another object is to provide such a display in which an additional graphic image area appears as the ice melts and the reservoir volume is expanded.

A further object is to provide such a display which is lightweight and easily transported.

Still yet another object is to provide such a display cooler which can be manufactured relatively easily and economically.

SUMMARY OF THE INVENTION

It has now been found that the foregoing and related objects may be readily attained in a cooler assembly for storing beverage containers on ice, which includes an outer container and a buoyant inner container assembly within the outer container which is dimensioned to slide vertically within the outer container. A container recess is provided in the upper surface of the inner container assembly to hold beverage containers and ice, and the assembly includes means for draining the liquid formed by melting ice from the recess into the outer container. The inner container assembly has a buoyancy which will float it upon the liquid which is drained into the outer container.

Generally, the inner container assembly includes an inner container having a base wall and a sidewall cooperating to provide the recess, and a buoyant member below the inner container. In its preferred form, a drain tube drains the liquid in the inner container and the drain tube is secured to the base wall of the inner container and to the buoyant member, thereby coupling the container and the buoyant member.

Preferably, the base wall and the sidewall of the inner container are double walled with insulation disposed between the double walls. The base wall and the sidewall of the outer container may also be double walled with insulation disposed between the double walls.

Conveniently, the buoyant member is fabricated from a cellular polystyrene synthetic resin. The inner container and the outer container may also be fabricated of synthetic resin.

In its preferred form, the inner container assembly and the outer container are of circular cross section. The cooler assembly generally includes a conduit through the sidewall of the outer container adjacent the base wall of the outer container, and a valve in the conduit for draining liquid from the outer container.

In an alternate form, the inner container includes a circumferential flange around its upper periphery, and a depending wall on the flange extends along the outer surface of the sidewall of the outer container.

DETAILED DESCRIPTION OF THE PREFERRED EMBODIMENTS

Figure 1:
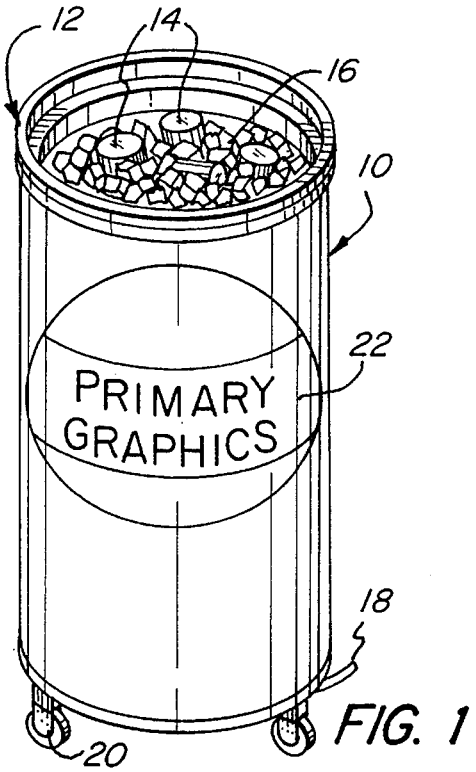
FIG. 1 is a perspective view of a cooler assembly embodying the present invention with ice and containers disposed therein.
Figure 2:
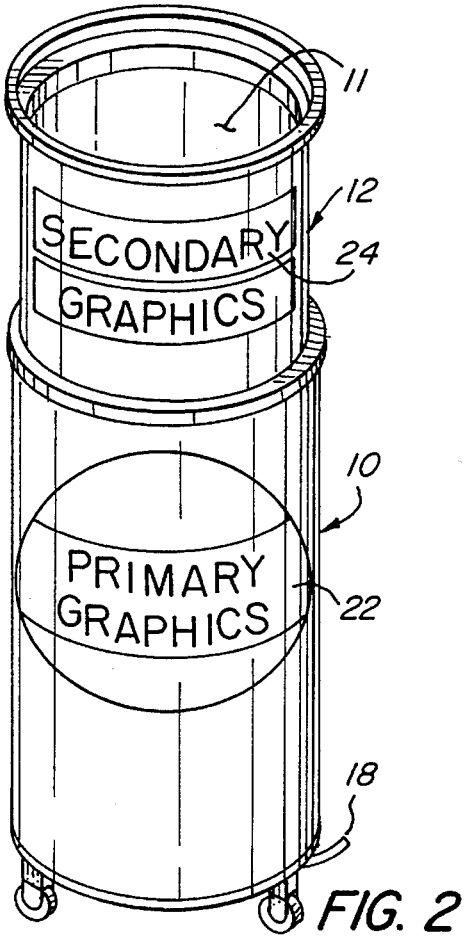
FIG. 2 is a perspective view of the cooler assembly of the present invention with the buoyant inner container elevated above the outer container base.
Figure 3:
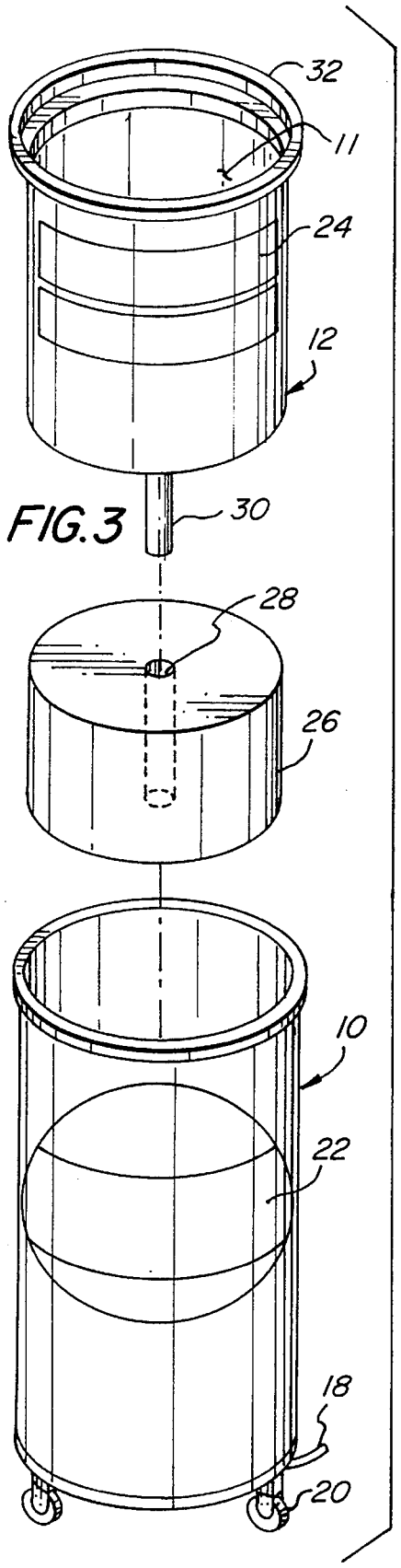
FIG. 3 is an exploded view of the cooler assembly.

Turning first to FIGS. 1 and 2, therein illustrated is a telescopic display cooler embodying the present invention and including an outer container generally designated by the numeral 10 and a buoyant inner container generally designated by the numeral 12. Ice 16 is placed within the container recess 11 in the inner container 12 to provide cold storage for beverage containers 14.

Figure 4:
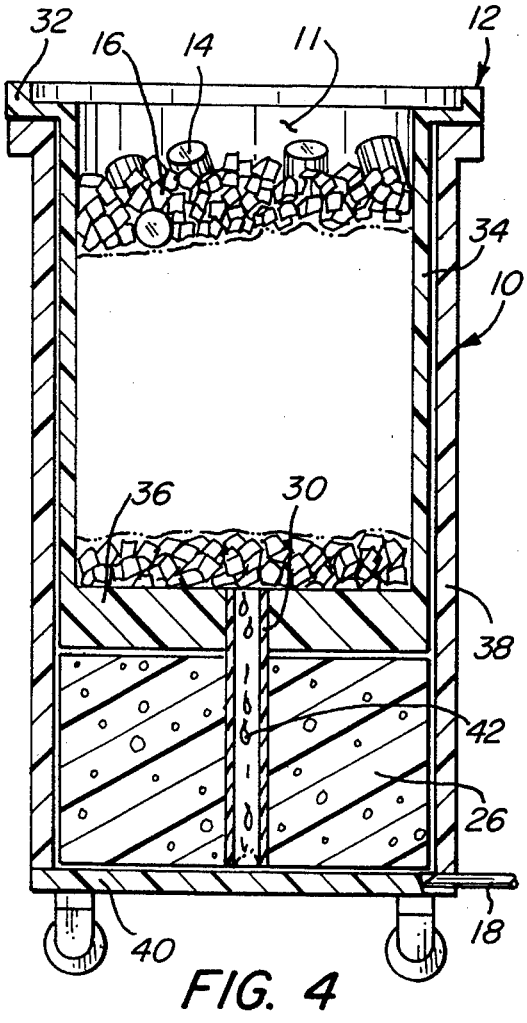
FIG. 4 is a vertical cross sectional view of the cooler assembly of FIG. 1.
Figure 5:
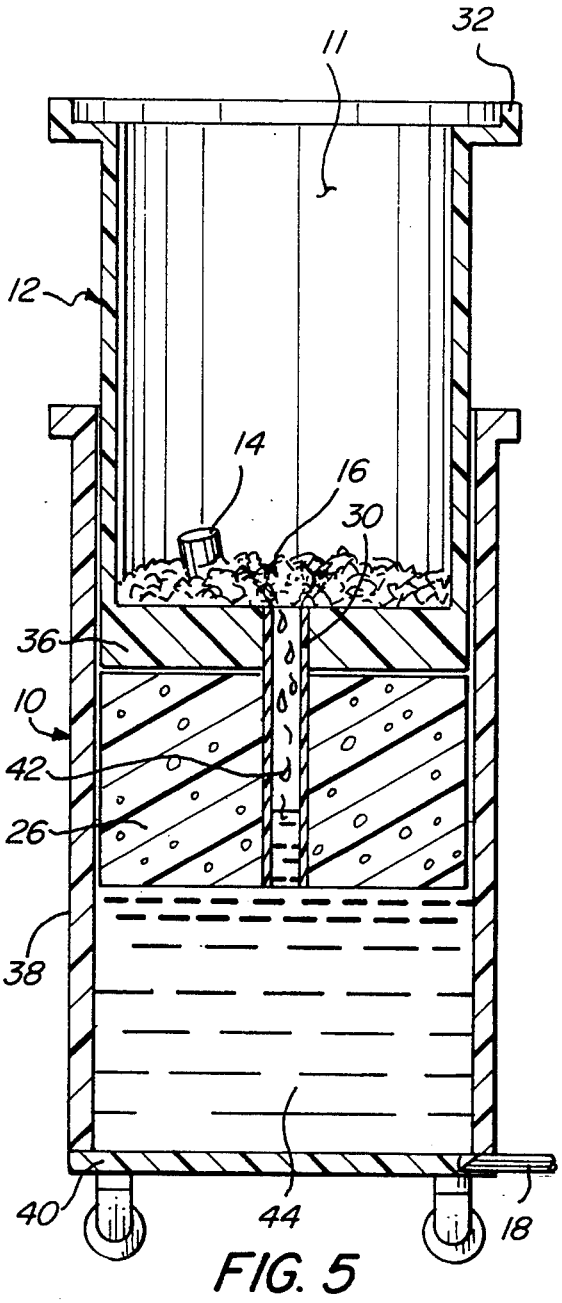
FIG. 5 is a cross sectional view similar to FIG. 4 with the buoyant inner container floating on water in the outer container.
Figure 9:
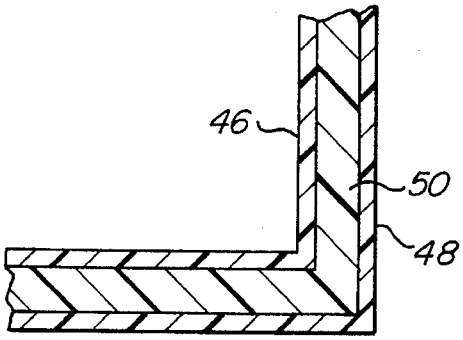
FIG. 9 is a partial sectional view of an embodiment of container construction using double walls for both the inner and outer containers and drawn to a greatly enlarged scale.

As best seen in FIGS. 4 and 5, the containers 10 and 12 have sidewalls 34 and 38 respectively, and base walls 36 and 40. In the illustrations, the walls are a single ply and may be fabricated from an insulating material such as cellular polystyrene. Preferably, the inner, or both of the containers are double walled as seen in FIG. 9 with inner and outer walls 46, 48 of a non-cellular resin and an intermediate layer 50 of an insulating material.

As seen in FIGS. 2 and 4–5, the inner container 12 is coupled with a float 26 to provide an inner container assembly with additional buoyancy.

A drain pipe 30 passes through and is secured to the center of the base wall 36 of the inner container 12. The drain pipe 30 also passes through an aperture 28 in the float 26. This secures the drain pipe 30 to the float 26 and couples the inner container 12 with the float 26.

As shown in FIGS. 1 and 4, when the mixture of ice 16 and beverage containers 14 is initially placed within the inner container 12, the inner container 12 is disposed almost entirely within the outer container 10 with only circumferential flange 32 at the upper end of the sidewall 38 abutting the upper edge of the sidewall 34 of the outer container 10. The weight of the inner container 12 and its contents is supported by the flange 32 resting atop the sidewall 38 of the outer container 10. If so dimensioned, the weight may also be supported by seating of the float 26 on the base wall 40 of the outer container 10.

As the ice 16 begins to melt, the water 42 is drained from the inner container 12 through the drain pipe 30, and the water 42 collects into a pool 44 at the bottom of the outer container 10. Thus, the outer container 10 acts as a storage reservoir for the pool 44, which increases in volume as the ice 16 melts as shown in FIG. 5.

Once the upward buoyant force (based on the weight of the fluid displaced) exceeds the weight of the inner container 12, its contents and the float, the inner container 12 will float in the pool of water 44. As the ice 16 continues to melt and beverage containers 14 are removed by consumers from the inner container 12, the weight of the inner container 12 is decreased and the inner container 12 will float higher in the water pool 44. The rise of the inner container 12 also coincides with the increasing level of the water pool 44. Since the inner container 12 tends to float above its own water run-off in the pool 42, the collected water 44 does not accumulate inside the inner container recess 11 to form an ice water bath. However, the ice water pool 44 continues to provide some cooling action for the contents of the inner container 12.

The water pool 44 which collects at the bottom of the outer container 10 may be completely drained through a drainage port 18 located at the bottom of the outer container 10. A valve (not shown) may open the drainage coupling 18 and cause the water 44 to flow from the outer container 12 into an open floor drain, or, if attached to a hose, into a water pail. Because the water pool 44 in the outer container 10 is under pressure from the weight of the inner container 12 and its contents floating above it, a drain hose may be held higher than the level of the water pool 44 in the outer container 10 and continue to drain. As a result, a pail higher than the drainage coupling 18 may be used.

The cooler is also provided with casters 20 on the outer container 10 for mobility. In normal operation, a cooler with a full water reservoir may be wheeled from its point of purchase location to the location of a floor drain where the water pool 44 may be quickly and easily emptied.

As shown in FIG. 1, a primary graphic image 22 is provided on the outer surface of the outer container 10 and generally promotes the product which is in the cooler. A purpose of the graphics 22 is to promote the beverage product within the cooler, and it may also entice the consumer into an impulse purchase of the product if this is at a point of purchase.

As seen in FIG. 2, the rise of the inner container 12 on the water pool 44 exposes the outer surface of the inner container 12 on which additional, secondary graphics 24 may be placed. The second graphic image 24 continues to appear and grow as the ice 16 in the cooler melts and beverage containers 14 are removed from the cooler. The movement of this graphic image also provokes consumer interest.

Figure 6:
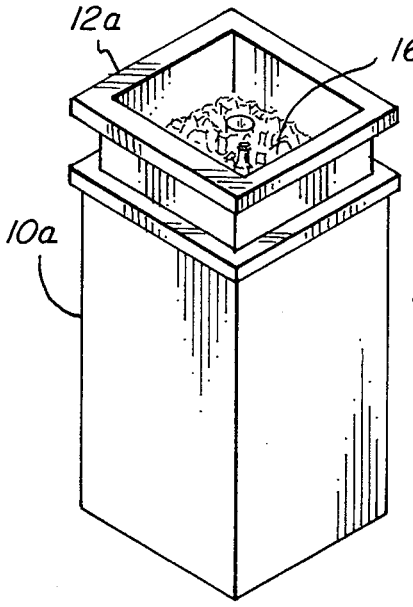
FIG. 6 is a perspective view of an alternate configuration for the cooler assembly.
Figure 7:
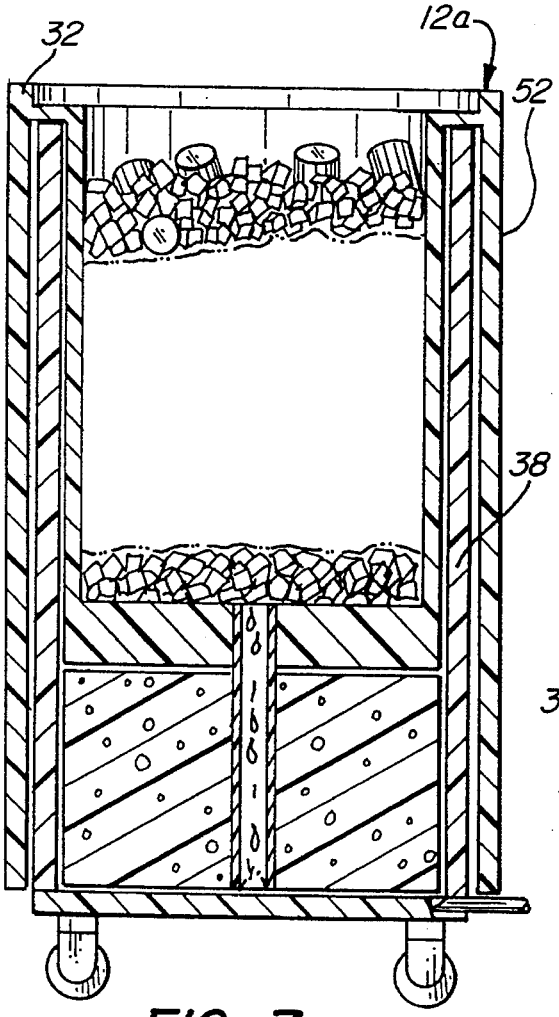
FIG. 7 is a vertical cross sectional view of an alternate configuration for the cooler assembly.
Figure 8:
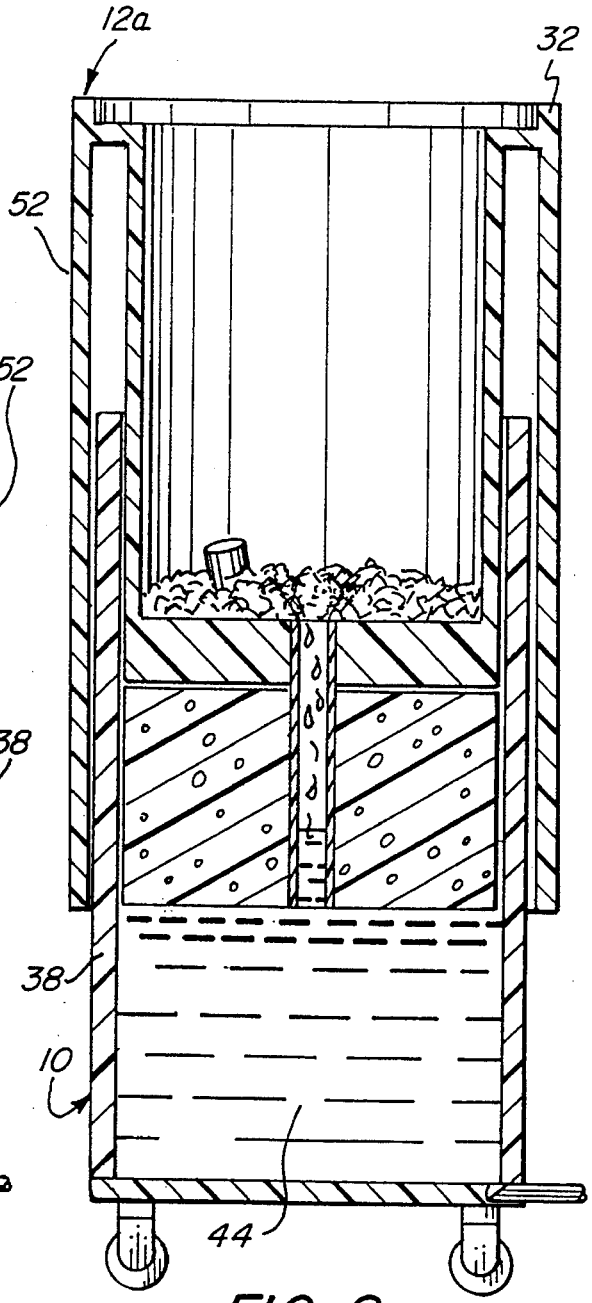
FIG. 8 is a cross sectional view similar to FIG. 7 with the buoyant inner container floating on water in the outer container.

Referring next to FIGS. 6 & 7, another embodiment is shown in which the inner container 12 has a depending wall 52 on the flange 32 and it extends along the outer surface of outer container 10. In this embodiment, the rise of the inner container 12 on the water pool 44 exposes the outer surface of the outer container 10 on which additional, secondary graphics 24 may be placed.

The novel idea of a telescopic display cooler is applicable to coolers of various shapes and sizes in addition to the cylindrical coolers shown in FIGS. 1–5, or a cooler with a rectangular cross section as shown in FIG. 6. Moreover, a version of smaller size may be used for icing champagne or wine bottles in restaurants or homes.

Various materials may be employed for the construction of the cooler. The inner and outer containers are preferably constructed of thermoplastic resins such as high density polyethylene, high density polypropylene, and high density polystyrene. To provide insulating characteristics and durability, the container may be fabricated with cellular core with a dense skin such as expanded polystyrene, expanded polyurethane, and expanded polyethylene. The flotation device may be provided by cellular resin such as polystyrene or a blow molded hollow plastic float.

If so desired, the inner or both containers may be fabricated from a pair of interfitting elements provided a spaced double wall construction with a cellular resin or the like therebetween. This allows use of high strength skins for durability, and high insulating materials for the core.

Thus, it can be seen from the foregoing detailed description and the accompanying drawings that the novel display cooler of the present invention is one which effectively drains water from a recess in the inner container containing ice and beverage containers, to a holding tank in the outer container with the inner container floating on a pool of ice water. It also provides a unique and interesting graphic image which appears to grow as the ice in the cooler melts and the product is removed from the cooler. The telescopic cooler may be readily adapted to a variety of sizes and to a variety of sizes and types of beverage containers.

Having thus described the invention, what is claimed is:

1. A cooler assembly for storing beverage containers on ice, comprising:

(a) an outer container having a base wall and a sidewall;

(b) a buoyant inner container assembly within said outer container, said inner container assembly being dimensioned to slide vertically within said outer container, said inner container assembly providing a container recess in its upper surface adapted to hold beverage containers and ice therein, said inner container assembly including means for draining the liquid formed by melting ice from said container recess into said outer container, said inner container assembly having a buoyancy which will float it upon the liquid which is drained into said outer container, said inner container assembly including an inner container having a base wall and a sidewall cooperating to provide said recess, a buoyant member below said inner container, said base wall and said sidewall of said inner container being double walled with insulating means disposed between said double walls.

2. The cooler assembly in accordance with claim 1 wherein said means for draining the liquid in said inner container assembly includes a drain tube secured to said base wall of said inner container and to said buoyant member, thereby coupling said inner container and said buoyant member.

3. The cooler assembly in accordance with claim 1 wherein said buoyant member is fabricated from synthetic resin.

4. The cooler assembly in accordance with claim 3 wherein said buoyant member is a cellular polystyrene.

5. The cooler assembly in accordance with claim 1 wherein said base wall and said sidewall of said outer container are double walled with insulating means disposed between said double walls.

6. The cooler assembly in accordance with claim 1 wherein said inner container and said outer container are fabricated of synthetic resin.

7. The cooler assembly in accordance with claim 1 wherein said inner container assembly and said outer container are of circular cross section.

8. The cooler assembly in accordance with claim 1 wherein said cooler assembly includes means for draining liquid from said outer container.

9. The cooler assembly in accordance with claim 8 wherein said liquid draining means includes a conduit through said sidewall of said outer container adjacent said base wall of said outer container, and a valve in said conduit.

10. A cooler assembly for storing beverage containers on ice, comprising:

(a) an outer container having a base wall and a sidewall;

(b) a buoyant inner container assembly within said outer container, said inner container assembly being dimensioned to slide vertically within said outer container, said inner container assembly providing a container recess in its upper surface adapted to hold beverage containers and ice therein, said inner container assembly including means for draining the liquid formed by melting ice from said container recess into said outer container, said inner container assembly having a buoyancy which will float it upon the liquid which is drained into said outer container, said inner container assembly including an inner container having a base wall and a sidewall cooperating to provide said recess, a buoyant member below said inner container, said sidewall of said inner container including an outwardly extending flange about its upper periphery and a depending wall on said flange, said depending wall extending along the outer surface of said sidewall of said outer container.

11. A cooler assembly for storing beverage containers on ice, comprising:

(a) an outer container having a base wall and a sidewall;

(b) a buoyant inner container assembly within said outer container, said inner container assembly being dimensioned to slide vertically within said outer container, said inner container assembly providing a container recess in its upper surface adapted to hold beverage containers and ice therein, said inner container assembly including means for draining the liquid formed by melting ice from said container recess into said outer container, said inner container assembly having a buoyancy which will float it upon the liquid which is drained into said outer container, said inner container assembly including an inner container having a base wall and a sidewall cooperating to provide said recess, and a buoyant member below said inner container, and said means for draining the liquid in said inner container includes a drain tube secured to said base wall of said inner container and to said buoyant member, thereby coupling said container and said buoyant member, said cooler assembly includes means for draining liquid from said outer container, said base wall and said sidewall of said inner container being double-walled with insulating means disposed between the double walls, said base wall and said sidewall of said outer container being double walled with insulating means disposed between said double walls, and said inner container and said outer container being fabricated of synthetic resin.

12. The cooler assembly in accordance with claim 11 wherein said buoyant member is fabricated from synthetic resin and said buoyant member is a cellular polystyrene.

13. The cooler assembly in accordance with claim 11 wherein said inner container assembly and said outer container are of circular cross section, said liquid draining means includes a conduit through said sidewall of said outer container adjacent said base wall of said outer container, and a valve in said conduit.

* * * * *